US008337279B2

(12) United States Patent
Dhandapani et al.

(10) Patent No.: US 8,337,279 B2
(45) Date of Patent: Dec. 25, 2012

(54) CLOSED-LOOP CONTROL FOR EFFECTIVE PAD CONDITIONING

(75) Inventors: Sivakumar Dhandapani, San Jose, CA (US); Stan D. Tsai, Fremont, CA (US); Daxin Mao, San Jose, CA (US); Sameer Deshpande, Milpitas, CA (US); Shou-Sung Chang, Stanford, CA (US); Gregory E. Menk, Pleasanton, CA (US); Charles C. Garretson, San Jose, CA (US); Jason Garcheung Fung, Sunnyvale, CA (US); Christopher D. Cocca, Fremont, CA (US); Hung Chih Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 777 days.

(21) Appl. No.: 12/489,132

(22) Filed: Jun. 22, 2009

(65) Prior Publication Data

US 2009/0318060 A1 Dec. 24, 2009

Related U.S. Application Data

(60) Provisional application No. 61/074,956, filed on Jun. 23, 2008.

(51) Int. Cl.

| | |
|---|---|
| ***B24B 1/00*** | (2006.01) |
| ***B24B 49/00*** | (2006.01) |
| ***B24B 51/00*** | (2006.01) |

(52) U.S. Cl. ..... 451/9; 451/10; 451/11; 451/21; 451/56

(58) Field of Classification Search ..... 451/5, 8, 451/10, 11, 21, 56, 72, 443, 9
See application file for complete search history.

(56) References Cited

U.S. PATENT DOCUMENTS

| | | | | |
|---|---|---|---|---|
| 6,773,332 | B2 | 8/2004 | Moore | |
| 7,018,269 | B2 | 3/2006 | Anderson | |
| 7,024,268 | B1 | 4/2006 | Bennett et al. | |
| 7,040,956 | B2 | 5/2006 | Paik | |
| 7,097,535 | B2 | 8/2006 | Glashauser et al. | |
| 7,198,546 | B2 | 4/2007 | Berman et al. | |
| 7,247,080 | B1 | 7/2007 | Bennett et al. | |
| 7,258,600 | B1 | 8/2007 | Benner | |
| 7,452,264 | B2 * | 11/2008 | Mavliev et al. | 451/56 |
| 7,963,826 | B2 * | 6/2011 | Nangoy et al. | 451/56 |

(Continued)

OTHER PUBLICATIONS

International Search Report and Written Opinion of the International Searching Authority mailed Feb. 2, 2010 in PCT/US2009/048243.

*Primary Examiner* — Timothy V Eley
(74) *Attorney, Agent, or Firm* — Patterson & Sheridan, LLP

(57) ABSTRACT

A method and apparatus for conditioning a polishing pad is provided. The conditioning element is held by a conditioning arm rotatably mounted to a base at a pivot point. An actuator pivots the arm about the pivot point. The conditioning element is urged against the surface of the polishing pad, and translated with respect to the polishing pad to remove material from the polishing pad and roughen its surface. The interaction of the abrasive conditioning surface with the polishing pad surface generates a frictional force. The frictional force may be monitored by monitoring the torque applied to the pivot point, and material removal controlled thereby. The conditioning time, down force, translation rate, or rotation of the conditioning pad may be adjusted based on the measured torque.

20 Claims, 6 Drawing Sheets

U.S. PATENT DOCUMENTS

2002/0106971 A1 8/2002 Rodriquez et al.
2004/0259477 A1 12/2004 Anderson
2005/0142987 A1 6/2005 Kramer et al.
2007/0298692 A1* 12/2007 Mavliev et al. ..... 451/56
2008/0014845 A1* 1/2008 Yilmaz et al. ..... 451/443

* cited by examiner

CLOSED-LOOP CONTROL FOR EFFECTIVE PAD CONDITIONING

CROSS-REFERENCE TO RELATED APPLICATIONS

This application claims benefit of U.S. provisional patent application Ser. No. 61/074,956, filed Jun. 23, 2008, which is herein incorporated by reference.

FIELD

Embodiments of the present invention generally relate to an apparatus and method for conditioning a polishing surface in an electrochemical mechanical processing system.

BACKGROUND

Chemical Mechanical Polishing (CMP) is a process widely used in the manufacture of semiconductor devices. Layers and structures are deposited and formed on a semiconductor substrate by various processes. Usually, these formation processes result in a surface that is not planar, or certain features formed in the substrate being covered and needing to be exposed. CMP is a process by which material is removed from the surface of a substrate to make it more planar (sometimes this process is referred to as Chemical Mechanical Planarization) and to expose desireable features.

During the CMP process, a polishing pad is used to remove material from the substrate, which is the mechanical aspect of the process. The pad abrades the surface of the substrate, usually with the help of an abrasive composition applied to the pad. The abrasive composition may include components selected to enhance the removal process chemically, providing the chemical aspect of the process. Some variations additionally use electrochemical means to enhance the process further (Electrochemical Mechanical Planarization or Polishing). As material is removed from the substrate, it collects on the pad and builds up in the abrasive composition. Also, as the pad is used its abrasive quality diminishes due to wear. Buildup of polishing byproduct material, and wear on the polishing pad requires that the pad be conditioned to restore its polishing capability. New pads must also be conditioned before they can be beneficially used.

Pad conditioning generally involves scouring the pad with an abrasive article to remove material that may be fouling the abrasive surface of the pad and to restore roughness to the pad. A conditioning pad contacts the polishing pad, abrading material from the pad and cutting grooves and features into the surface of the pad to restore roughness.

It is a constant challenge in the semiconductor industry that devices formed on semiconductor substrates grow smaller and denser over time. As devices grow smaller, all processes involved in forming the devices are challenged to produce these devices reliably. CMP processes are no exception. The smaller devices are more delicate, the layers to be removed from the substrates are thinner, the layers beneath that need to be preserved are thinner, and the features to be exposed by polishing are smaller and more easily damaged. The tolerance for variation in all processes is less, and new methods are required to meet these tolerances.

FIG. 1 is a graph showing the result of a prior art conditioning process. For a given conditioning pad, the effectiveness of conditioning the pad declines as successive substrates are processed on the apparatus. Line 102 illustrates this tendency. As a result, the effectiveness of the pad in polishing substrates drifts over time, producing non-uniform results from substrate to substrate. It is desired that conditioning effectiveness be more uniform, as hypothetically illustrated by line 104, to remove this source of variation and improve process results.

Thus, there is a continuing need for a method and apparatus for conditioning a polishing pad that yields uniform pad performance over the life of the conditioning pad as successive polishing pads are conditioned.

SUMMARY

Embodiments disclosed herein provide a method of conditioning a polishing element, comprising contacting a surface of a conditioning element with a surface of the polishing element; applying a conditioning force to the conditioning element over a conditioning time; moving the conditioning element with respect to the polishing element; measuring the frictional force between the conditioning element and the polishing element; adjusting the conditioning time; and adjusting the conditioning force. The conditioning time may be limited to a fraction of the time the polishing element is used to polish a substrate, and may be adjusted together with, or separate from, the down force.

Other embodiments provide a method of conditioning a polishing element, comprising disposing an abrasive conditioning element at an end of a conditioning arm rotatably coupled to an actuator at a pivot point; using the actuator to sweep the conditioning arm across the polishing element while the abrasive conditioning element contacts a surface of the polishing element to remove material from the polishing element; applying a downward force to the abrasive conditioning element; measuring the torque applied to the pivot point by the actuator; comparing the measured torque to a standard value; adjusting the amount of material removed from the surface of the polishing element by the abrasive conditioning element. Adjusting the material removal may be accomplished by adjusting the conditioning time, the contact force between the conditioning element and the polishing element, or the rate of movement of the conditioning element with respect to the polishing element.

Other embodiments provide a method of removing material from a surface of a process element, comprising contacting an abrasive element with the surface of the process element; applying a contacting force to the abrasive element; translating the abrasive element across the surface of the process element during a processing time; monitoring the translation force required to translate the abrasive element across the surface of the process element; using a controller to adjust the processing time and contacting force based on comparison of the measured translation force with a standard.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The invention generally provides an apparatus and methods for conditioning a polishing pad for a planarization process. Embodiments described herein relate to a conditioning disk for conditioning, which includes scoring and/or dressing, a polishing surface of a polishing pad used in a CMP process. A conditioning disk generally comprises an annular body disposed on a backing plate. The backing plate is adapted to be coupled to a conditioning head assembly that is used to urge the conditioning disk against the polishing surface of the polishing pad. The annular body comprises a polycrystalline diamond covering or coating that is adapted to refresh, score, or condition the polishing surface when in contact with the polishing surface. In some embodiments, the polycrystalline diamond covering is machined to include a plurality of substantially identical structures which condition the polishing surface of the polishing pad. The size, pitch, and height of the plurality of structures are controlled with tight tolerances to enhance the cut rate without adversely increasing surface roughness of the polishing surface, and to prevent clogging or accumulation of polishing by-products, such as metal particles and/or portions of the polishing surface that may be spent and/or torn away from the polishing surface.

Figure 1:
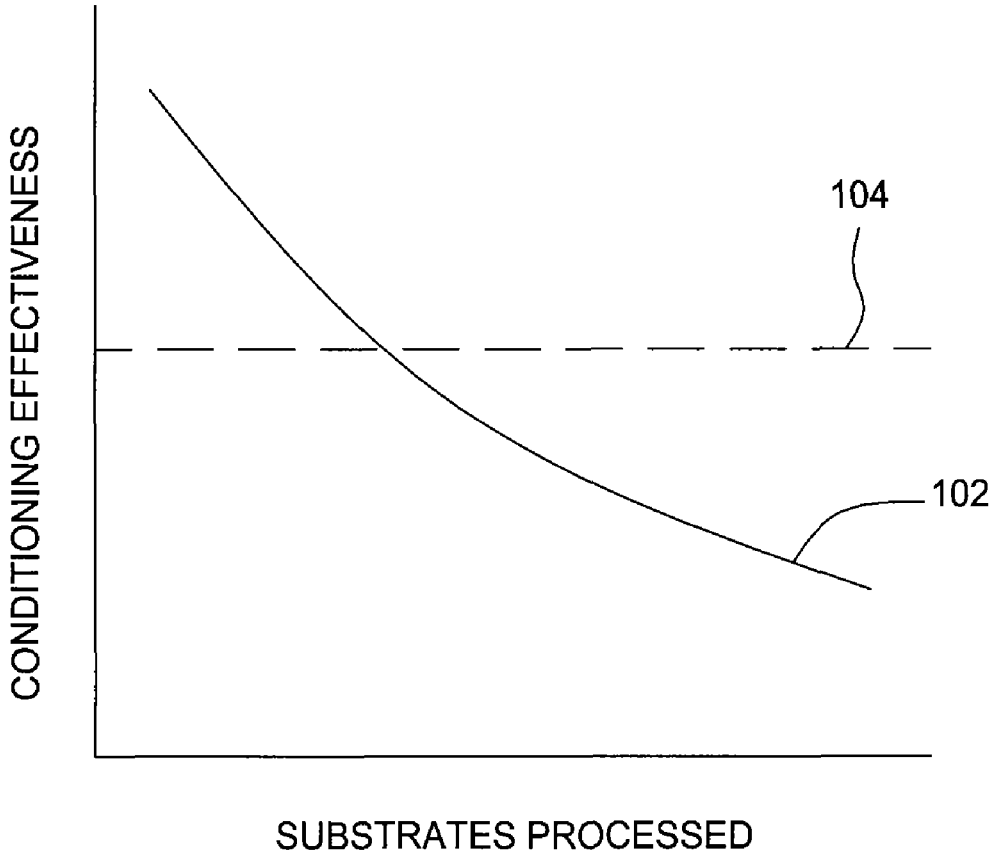
FIG. 1 (PRIOR ART)
FIG. 1 is a graph showing the result of a prior art conditioning process.
Figure 2:
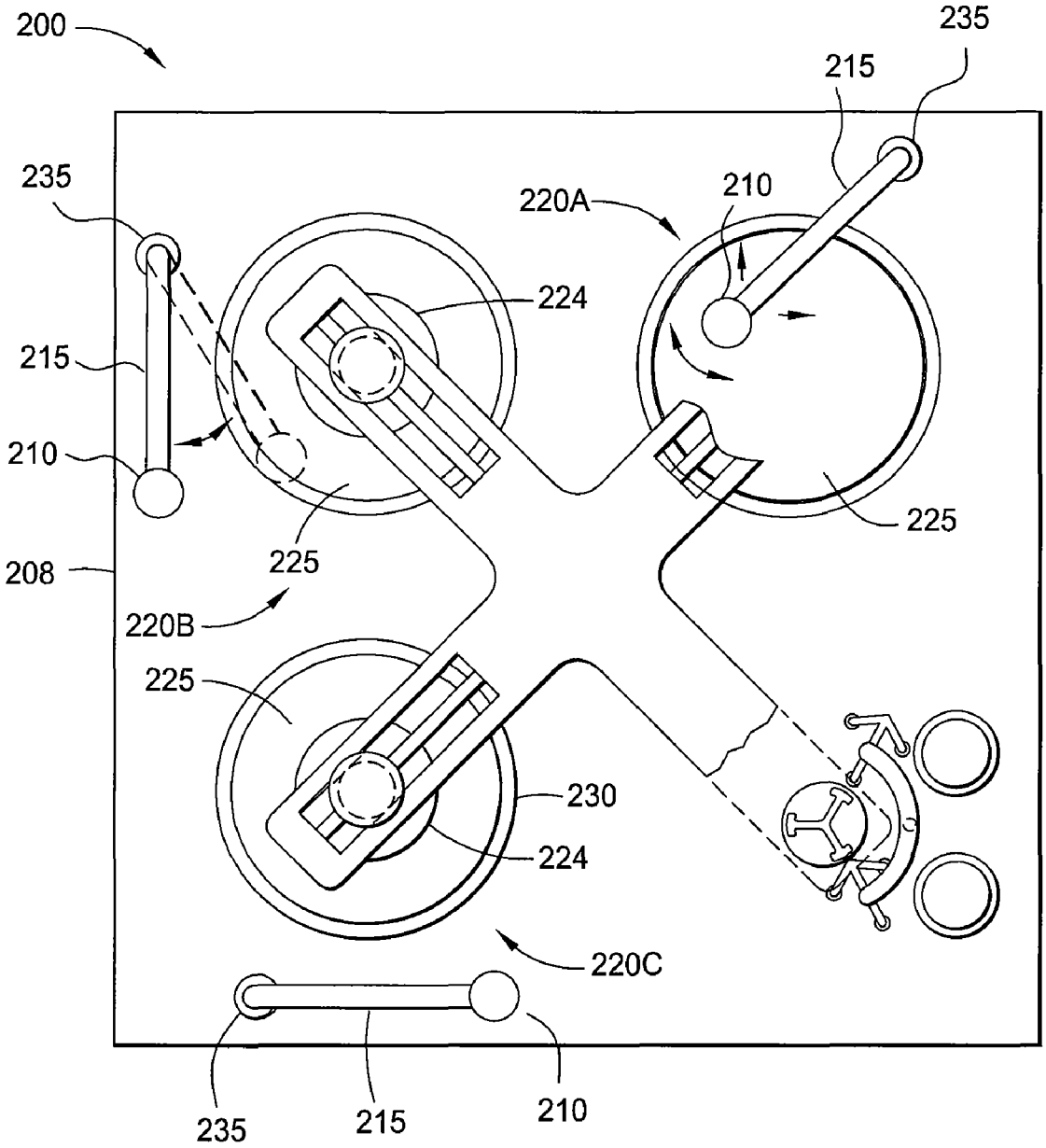
FIG. 2 is a top view of a conditioning apparatus according to one embodiment of the invention.

FIG. 2 is a top view of one embodiment of a portion of a processing system 200 having one embodiment of a pad dresser 210 disposed on a conditioning device 215. In one embodiment, the system 200 is configured to planarize or polish semiconductor substrates and generally includes a polishing module 208, which includes one or more polishing stations 220A-220C disposed therein. Each polishing station 220A-220C includes a platen 230 that supports a polishing material 225. During processing, a substrate is urged against the polishing material 225 by a substrate carrier head 224 and the platen 230 rotates to provide at least a portion of relative polishing motion between the substrate and the polishing material 225. Processing systems that may be adapted to benefit from embodiments described herein include the REFLEXION® and SYCAMORE polishing systems available from Applied Materials, Inc., located in Santa Clara, Calif., although other polishing systems may be utilized.

The conditioning device 215 is disposed proximate each polishing station 220A-220C and is adapted to condition the polishing material 225 disposed on each platen 230. Each conditioning device 215 is adapted to move between a position clear of the polishing material 225 and platen 230 as shown in FIG. 2, and a conditioning position over the polishing material 225 as shown on polishing stations 220B and 220C. In the conditioning position, the conditioning device 215 selectively engages the polishing material 225 to work the surface of the polishing material 225 to a state that produces desirable polishing results. The conditioning device 215 may sweep and/or rotate relative to the polishing material 225, which may additionally rotate on the platen 230 during conditioning. Operation of the conditioning process may be controlled by a controller in response to a preprogrammed process recipe, manual input by an operator of the equipment, and the like. Alternatively, or in combination, a stand-alone conditioning apparatus (not shown) located remote from the system 200 may be utilized to condition the polishing material 225.

The polishing material 225 includes a polishing surface that may be at least partially conductive. Examples of polishing material 225 may include a combination of dielectric and conductive materials, or may be entirely dielectric or entirely conductive. In one embodiment, the polishing material 225 may include dielectric or conductive materials having conductive elements disposed therein. The conductive elements may be flakes, particles, and the like that are disposed in a dielectric or conductive material, such as a polymer material. Examples of conductive materials used as conductive elements and/or the conductive material are copper, carbon based materials, gold, platinum, silver, tin, zinc, nickel, cobalt, and combinations thereof, among other conductive materials that are resistant to polishing chemistry. Carbon-based material includes carbon black, graphite, and carbon particles. Examples of conductive carbon-based materials include carbon powder, carbon fibers, carbon nanotubes, carbon nanofoam, carbon aerogels, graphite, and combinations thereof. In one embodiment, a conductive polishing material may include conductive foils, polymers polymer materials with conductive materials disposed therein, conductive meshes, conductive flakes, conductive fibers, or a fabric of interwoven conductive fibers. The conductive materials, fibers, or fabric may be disposed in a polymeric material.

Figure 3:
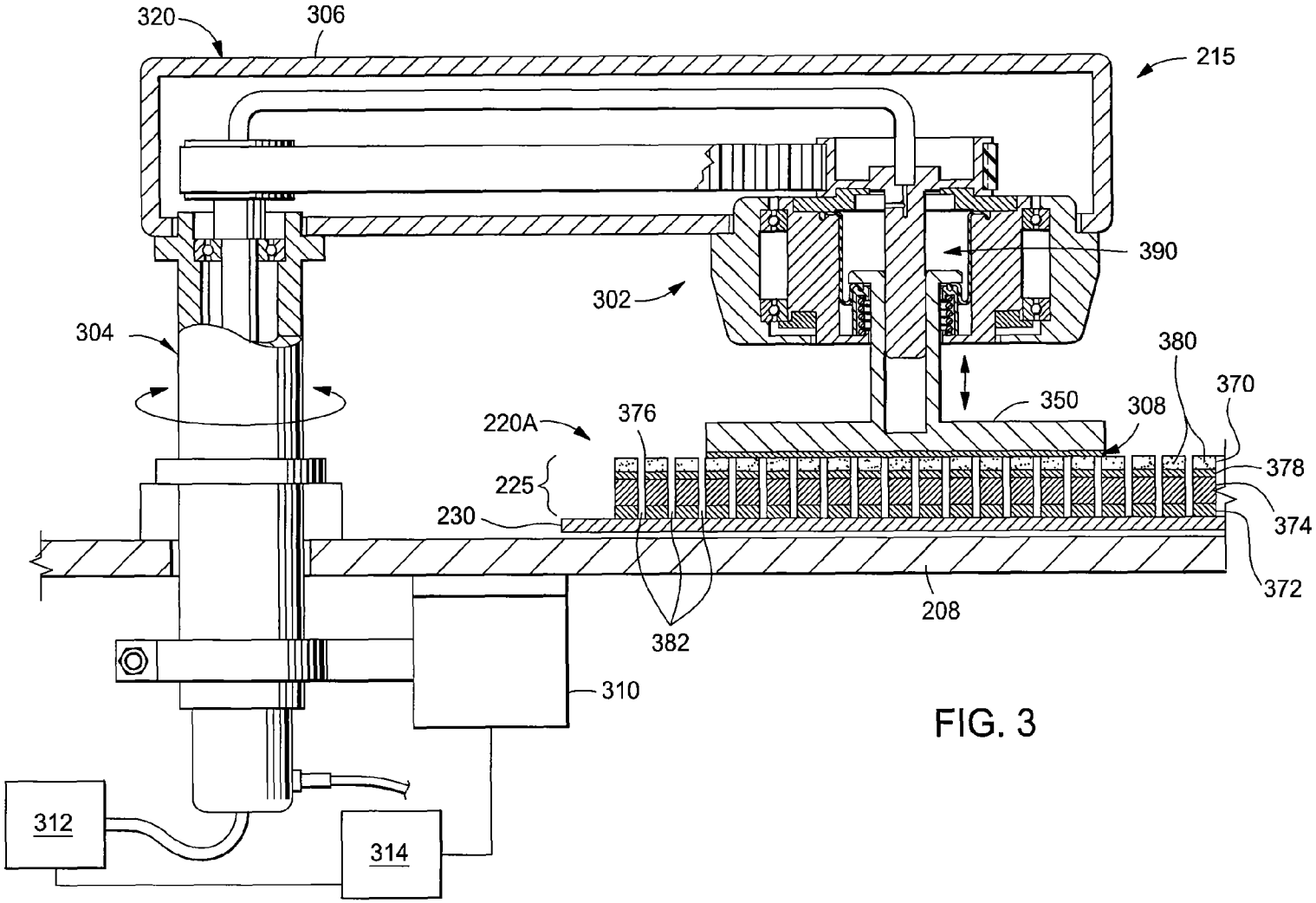
FIG. 3 is a sectional view of the conditioning apparatus of FIG. 2.

FIG. 3 is a sectional view of the conditioning device 215 of FIG. 2 showing one embodiment of a pad dresser 210. The pad dresser 210 is disposed above a polishing material 225. The conditioning device 215 generally includes a conditioning head assembly 302 coupled to a support member 304 by an arm 306. The support member 304 is disposed through a base of the polishing module 208. Bearings are provided between the base and the support member 304 to facilitate rotation of the support member 304. An actuator 310 is coupled between the base and the support member 304 to control the rotational orientation of the support member 304. The actuator 310 allows the arm 306 extending from the support member 304 to be rotated about the support member 304, thus laterally positioning the conditioning head assembly 302 relative to the polishing station 226A. Elevation of the conditioning device 215 and/or the conditioning head 350 is generally controlled by pressurizing or venting an expandable cavity 390 partially bounded by a diaphragm disposed in conditioning head assembly 302.

The pad dresser 210 is coupled to the conditioning head assembly 302 and may be selectively pressed against the polishing material 225 while rotating to condition the polishing material 225. The pad dresser 210 includes a backing plate and a conditioning surface. The backing plate and/or the conditioning surface are typically round, disk-shaped, or annular to facilitate rotation of the pad dresser 210 and enhance conditioning of the polishing material 225 and/or control of the conditioning process. In most embodiments, the polishing material 225 comprises a polishing pad having a polishing surface 370 and an attachment portion 372 that attaches to the backing plate 230.

During polishing, a substrate (not shown) is urged against the polishing material 225, with a downward force calculated to achieve a desired removal rate. The polishing material 225 may rotate on the platen 230 to translate the ridges and grooves of the polishing material across the substrate surface. The abrasive elements of the polishing material scour and abrade material from the substrate surface, and the resistance force applied by the substrate surface on each abrasive element of the polishing material generates a frictional force between the substrate and the polishing material. The substrate may also be rotated to increase removal rate. As one or both of the platen 230 and substrate are rotated, conductive material is removed from the face of the substrate by electrochemical and mechanical forces.

Before, during, or after the polishing process, the polishing surface 276 may require conditioning of the pad polishing surface in order to maintain predefined processing results. Conditioning may create, reform, and/or clear grooves and/or asperities in the polishing surface 276. In another application, conditioning of the polishing surface 276 refreshes the polishing surface 276. Refreshing may include at least one of exposing new or unused material on the polishing surface 276, removing polishing by-products, removing spent or torn portions of the polishing surface 276, and/or removal or minimization of oxides disposed in or on the polishing surface 276. The conditioning of the polishing surface 276 may be performed prior to polishing with a new polishing pad, during the polishing process to maintain and/or enhance surface roughness and removal rate of the polishing surface 276, or post-processing to prepare the polishing surface 276 for a new substrate to be polished.

A conditioning element such as those described herein is urged against the polishing surface. The conditioning element and the polishing surface may rotate, and the conditioning element may sweep across the polishing surface, as described above. Downward force is applied to the conditioning element to generate a desired amount of scouring, grooving, and roughening of the polishing surface. The interaction of abrasive elements of the conditioning element with the polishing surface generates a frictional force that is overcome by operation of the actuator 310. A sensor 312 monitors the frictional force by measuring the torque generated on the support member 304 by the actuator 310, and may provide that measurement to controller 314 configured to generate a control signal to the actuator 310. The controller 314 may also be configured to adjust the pressure inside the expandable cavity 390 to control the downward force applied to the conditioning element.

Figure 4:
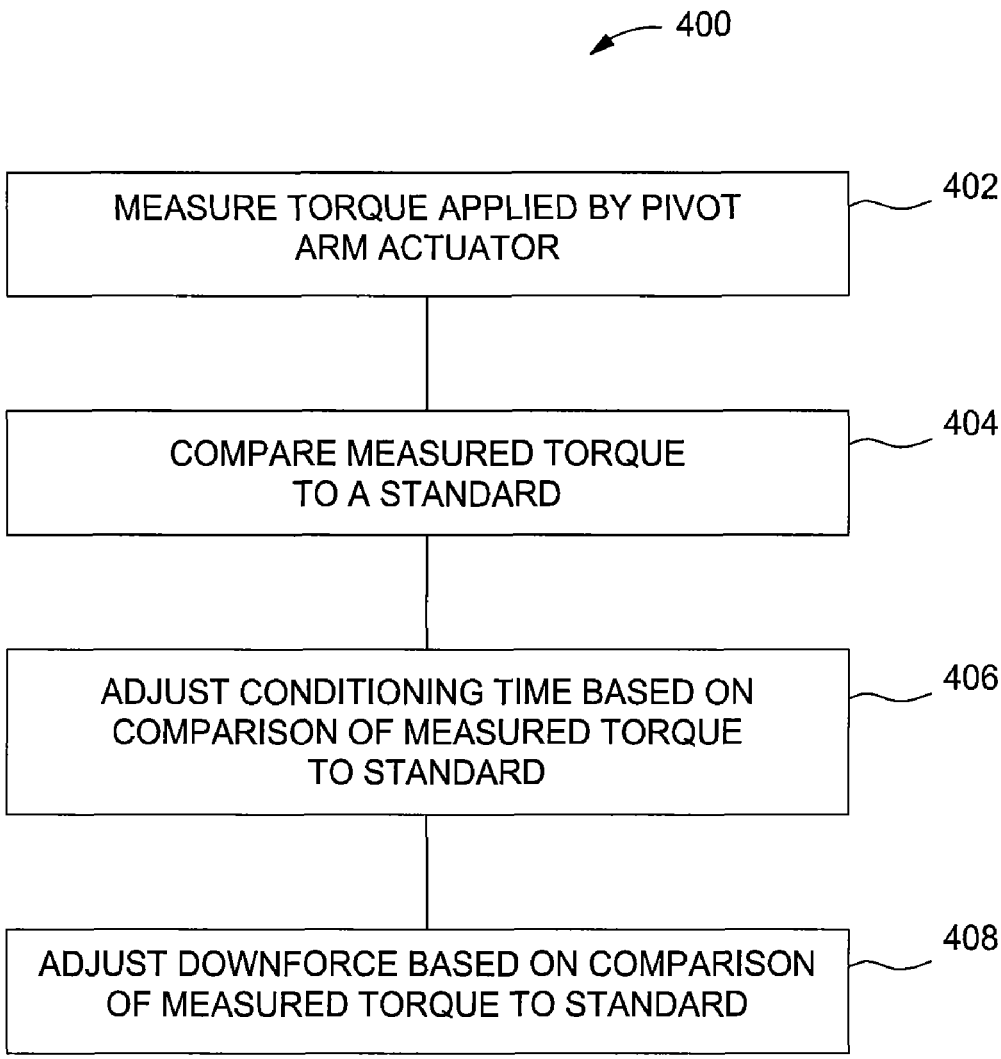
FIG. 4 is a flow diagram summarizing a method according to one embodiment of the invention.

FIG. 4 is a flow diagram summarizing a 400 method according to one embodiment of the invention. The method 400 achieves a conditioning process that is uniformly effective throughout the useful life of a polishing pad. At 402, the torque applied to a pivot point of the conditioning arm, such as the support member 304 of FIG. 3, by a motor such as the actuator 310 of FIG. 3 is measured by any suitable device. A resistance torsionmeter or electrical strain gauge may be used in some embodiments.

At 404, the measured torque is compared to a standard value, which may be a target value. The standard value is determined by the amount of friction desired between the conditioning element and the polishing surface. The frictional force is related to the effectiveness of conditioning. A high frictional force indicates material is being removed from the polishing surface at a high rate, but too high a removal rate results in reduced pad life. A low frictional force may indicate the polishing surface is not being roughened enough to provide effective processing of substrates.

At 406, an adjustment is made based on the comparison above. One adjustment is to the conditioning time. When the conditioning time has elapsed, conditioning may be interrupted by lifting the conditioning element off the polishing surface, even though polishing of a substrate is ongoing. If the frictional force is high, the polishing surface may be effectively conditioned in a shorter time, so the conditioning time is reduced to avoid excessive wear on the polishing surface and the conditioning element. If low, the conditioning time may be lengthened to achieve the desired results. The conditioning time will generally be controlled between 50% and 100% of the polishing time for a substrate. Conditioning of the polishing surface may take place exclusively while a substrate is being processed, or may proceed between processing of substrates. In some embodiments, conditioning may be continuous as substrates are positioned on the apparatus, processed, and removed from the apparatus. In other embodiments, conditioning may start before, during, or after polishing, and may end before, during, or after polishing.

In some embodiments, it may be necessary to increase or reduce the conditioning vigor by more than is possible through adjustments to conditioning time. At 408, the downforce may also be adjusted to increase or reduce the frictional force. Effective and reproduceable conditioning of a polishing surface results.

Figure 5:
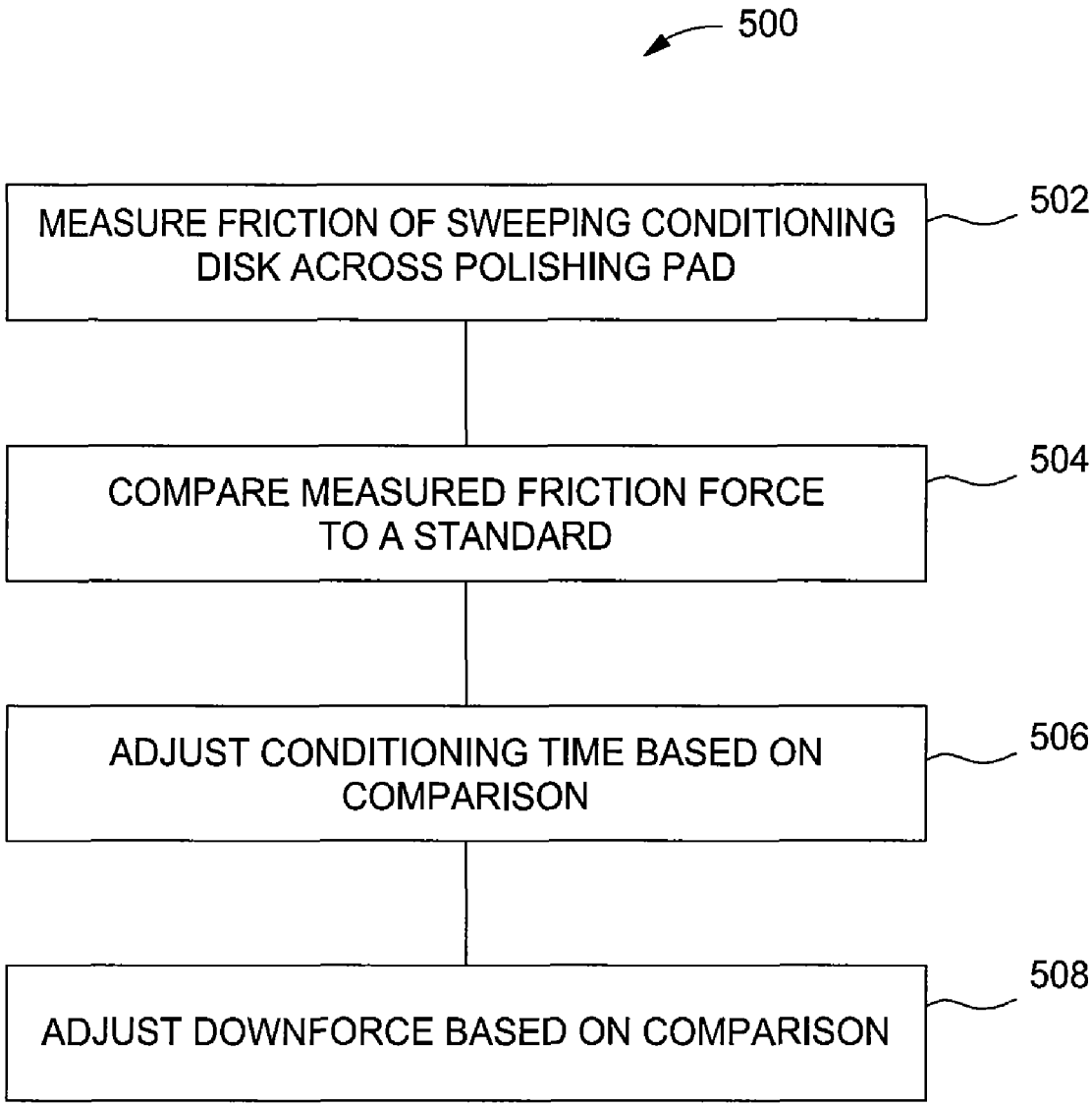
FIG. 5 is a flow diagram summarizing a method according to another embodiment of the invention.

FIG. 5 is a flow diagram summarizing a method 500 according to another embodiment of the invention. At 502, the friction of sweeping the conditioning element across the polishing surface is measured. The measurement may be by torque applied to the pivot point of the arm holding the conditioning element, or by any other suitable means, such as acoustic or thermophysical means.

At 504, the measured frictional force is compared to a standard value. The standard value is determined by the desired rate of material removal from the polishing surface, and the desired scoring and grooving of the surface. If the measured value deviates from the standard value, an adjustment is made at 506. The conditioning time may be adjusted at 506 to increase or decrease material removal from the polishing surface. Adjustments to the conditioning time are generally bounded by upper and lower limits, which may be determined by polishing time of a substrate, or by other process considerations such as platen rotation speed or arm sweep speed. For example, it may be advantageous to ensure conditioning time is long enough to encompass coverage of the entire width of the platen by the conditioning element in at least one sweep. In some processes, conditioning time may be required to complete more than one sweep. As described above in connection with method 400, conditioning may begin before, during, or after polishing, and may end before, during, or after polishing. The conditioning time may be shorter than, equal to, or longer than the polishing time. It is generally preferred that conditioning begins at the same time polishing begins, and ends at the same time polishing ends, or before.

In the event the desired conditioning effectiveness cannot be achieved by the adjustment of 506, the downforce may be adjusted at 508. The pressure inside the conditioning head may be adjusted to provide more or less force on the conditioning element. In some embodiments, the downforce and the conditioning time may be adjusted together or simultaneously. For example, if the measured frictional force indicates a material removal rate that is too high, the conditioning time and downforce may both be reduced at the same time. If the removal rate is too low, both may be increased at the same time.

Figure 6:
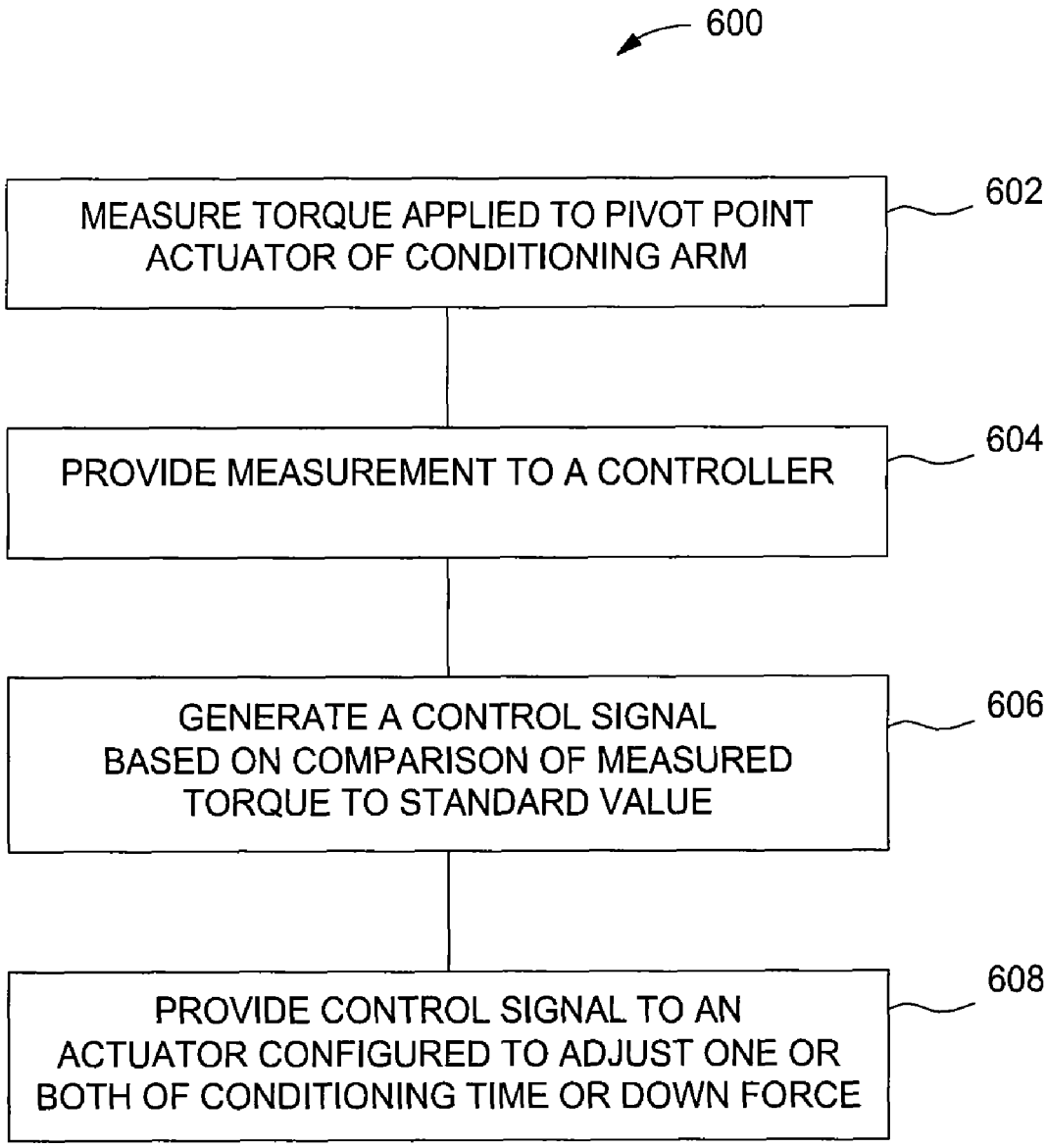
FIG. 6 is a flow diagram summarizing a method according to another embodiment of the invention.

FIG. 6 is a flow diagram summarizing a method 600 according to another embodiment of the invention. The method 600 accomplishes control of the rate of material removal in a polishing surface conditioning process. The amount of material being removed from the polishing surface is measured at 602. In one embodiment, the material removal rate may be measured by sensing the torque being applied to the pivot point actuator of a conditioning arm holding a conditioning element against the polishing surface. At 604, the measurement is provided to a controller, which compares the measured value to a standard value. The standard value is the value that represents a desired amount of material removed, an amount that results in effective conditioning of the polishing surface in the time allotted. The controller generates a control signal based on the comparison of the two values at 606. The control signal is provided to one or more actuators configured to adjust the conditioning time, the contact force between the conditioning element and the polishing surface, or both.

In some embodiments, the contact time may be limited. For example, when substrates are not being processed on the polishing surface, conditioning may be interrupted. In some embodiments, it may be desireable to condition the polishing surface when a substrate is disposed thereon and being processed. In other embodiments, it may be useful to limit the contact time to a fraction of the time the substrate is processed on the polishing surface. For example, in some embodiments the contact time may be between about 50% and about 100% of the polishing time. In embodiments wherein the conditioning element is translated across the polishing surface, it may be desireable to require that the contact time be no less than the time required to translate the conditioning element across the entirety of one dimension of the polishing surface. In an embodiment in which the polishing surface is an annular or disk-shaped surface, and the conditioning element is translated from an inner radius to an outer radius of the polishing surface, or from an outer radius to an inner radius of the polishing surface, it may be advantageous to require that the contact time be no less than the time required to translate the conditioning element from the inner to the outer radius, or vice versa, to ensure the entire polishing surface is conditioned.

In other embodiments, other variables may be adjusted to achieve effective conditioning results over the life of a conditioning element. In some embodiments, the conditioning element may rotate, and the rate of rotation may be adjusted. In other embodiments, the rate the conditioning element is translated across the polishing surface may be adjusted. In still other embodiments, the conditioning element may be translated and rotated according to specified patterns, which may be adjusted to affect the amount of material removed from the polishing pad.

While the foregoing is directed to embodiments of the invention, other and further embodiments of the invention may be devised without departing from the basic scope thereof, and the scope thereof is determined by the claims that follow.

What is claimed is:

1. A method of conditioning a polishing element, comprising:

contacting a surface of a conditioning element with a surface of the polishing element;

sweeping the conditioning element across the surface of the polishing element in a sweeping direction causing a frictional force in the sweeping direction;

applying a conditioning force to the conditioning element over a conditioning time;

moving the conditioning element with respect to the polishing element;

measuring the frictional force between the conditioning element and the polishing element;

adjusting the conditioning time; and adjusting the conditioning force.

2. The method of claim 1, further comprising comparing the frictional force to a standard value.

3. The method of claim 1, further comprising contacting the surface of the polishing element with a substrate to be polished over a polishing time; and limiting the conditioning time to a fraction of the polishing time.

4. The method of claim 3, wherein the conditioning time is at least 50% of the polishing time.

5. The method of claim 3, wherein the conditioning time is not more than the polishing time.

6. A method of conditioning a polishing element having a polishing surface, comprising:

disposing an abrasive conditioning element at an end of a conditioning arm rotatably coupled to an actuator at a pivot point;

using the actuator to sweep the conditioning arm across the polishing element while the abrasive conditioning element contacts a surface of the polishing element to remove material from the polishing element;

applying a downward force to the abrasive conditioning element;

measuring the torque applied to the pivot point by the actuator;

comparing the measured torque to a standard value;

adjusting the amount of material removed from the surface of the polishing element by the abrasive conditioning element.

7. The method of claim 6, wherein adjusting the amount of material removed from the surface of the polishing element by the abrasive conditioning element comprises adjusting the frictional force between the abrasive conditioning element and the polishing element.

8. The method of claim 6, wherein adjusting the amount of material removed from the surface of the polishing element by the abrasive conditioning element comprises adjusting the sweep speed of the conditioning arm across the polishing element.

9. The method of claim 6, wherein adjusting the amount of material removed from the surface of the polishing element by the abrasive conditioning element comprises adjusting the time the conditioning element contacts the polishing surface.

10. The method of claim 6, wherein adjusting the amount of material removed from the surface of the polishing element by the abrasive conditioning element comprises adjusting the downward force applied to the abrasive conditioning element by the conditioning arm.

11. The method of claim 6, wherein adjusting the amount of material removed from the surface of the polishing element by the abrasive conditioning element comprises concurrently adjusting the downward force applied to the abrasive conditioning element by the conditioning arm and the time the conditioning element contacts the polishing surface.

12. The method of claim 11, wherein the contact time is limited by the length of time a substrate is processed on the polishing surface.

13. The method of claim 12, wherein the contact time is at least 50% of the time a substrate is processed on the polishing surface.

14. The method of claim 12, wherein the contact time is between 50% and 100% of the time a substrate is processed on the polishing surface.

15. A method of removing material from a surface of a process element, comprising:

contacting an abrasive element with the surface of the process element;

applying a contacting force to the abrasive element applying a translation force to the abrasive element;

translating the abrasive element across the surface of the process element during a processing time;

monitoring the translation force required to translate the abrasive element across the surface of the process element;

using a controller to adjust the processing time and contacting force based on comparison of the measured translation force with a standard.

16. The method of claim 15, wherein the contact force is adjusted by pneumatic means.

17. The method of claim 15, wherein the processing time is limited, and the controller adjusts the contacting force after the processing time has reached a limit.

18. The method of claim 17, wherein the processing time is limited by the time a workpiece is disposed on the surface of the process element.

19. The method of claim 18, wherein the processing time is not less than 50% of the time the workpiece is disposed on the surface of the process element.

20. The method of claim 17, wherein the processing time is not less than the time required to translate the abrasive element across one dimension of the surface of the process element.

* * * * *